US009232582B2

(12) United States Patent
Knoedgen et al.

(10) Patent No.: US 9,232,582 B2
(45) Date of Patent: Jan. 5, 2016

(54) DRIVER CIRCUITS FOR SOLID STATE LIGHT BULB ASSEMBLIES

(71) Applicant: Dialog Semiconductor GmbH, Kirchheim/Teck-Nabern (DE)

(72) Inventors: Horst Knoedgen, Munich (DE); Stefan Zudrell-Koch, Hohenems (AT)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 14/250,416

(22) Filed: Apr. 11, 2014

(65) Prior Publication Data

US 2014/0217918 A1 Aug. 7, 2014

Related U.S. Application Data

(63) Continuation of application No. PCT/EP2012/070217, filed on Oct. 11, 2012.

(51) Int. Cl.
*H05B 41/36* (2006.01)
*H05B 33/08* (2006.01)

(52) U.S. Cl.
CPC ..... *H05B 33/0815* (2013.01); *H05B 33/0848* (2013.01)

(58) Field of Classification Search
CPC . H05B 33/0815; H05B 33/0848; H05B 37/02
USPC ..... 315/291, 294, 307, 224, 239, 17; 324/415
See application file for complete search history.

(56) References Cited

U.S. PATENT DOCUMENTS

| | | | | |
|---|---|---|---|---|
| 2005/0213353 | A1* | 9/2005 | Lys | 363/17 |
| 2010/0213859 | A1* | 8/2010 | Shteynberg et al. | 315/224 |
| 2011/0080110 | A1* | 4/2011 | Nuhfer et al. | 315/291 |
| 2012/0025729 | A1* | 2/2012 | Melanson et al. | 315/224 |
| 2012/0104975 | A1* | 5/2012 | Vigh et al. | 315/307 |
| 2012/0112665 | A1* | 5/2012 | Melanson et al. | 315/294 |
| 2013/0134905 | A1* | 5/2013 | Zhang et al. | 315/297 |
| 2013/0300310 | A1* | 11/2013 | Hu | 315/239 |
| 2015/0084535 | A1* | 3/2015 | King et al. | 315/224 |

OTHER PUBLICATIONS

Chinese Office Action 518028 and English language letter from Chinese patent firm ZYIP describing content, Jul. 23, 2015, DialogSemiconductor GmbH.

* cited by examiner

*Primary Examiner* — Douglas W Owens
*Assistant Examiner* — Syed M Kaiser
(74) *Attorney, Agent, or Firm* — Saile Ackerman LLC; Stephen B. Ackerman

(57) ABSTRACT

A driver circuit of solid state light bulb assemblies including light emitting diodes comprises a first power converter stage converting an input voltage into an intermediate voltage; a second power converter stage converting the intermediate voltage into a drive voltage for the light source; and a controller. The controller comprises a first control unit generating a first control signal for the first power converter stage; a second control unit generating a second control signal for the second power converter stage; and a state control unit determining a target state of the light source; wherein the first and second control units are receiving information indicative of the target state; and wherein the first and second control units are generating the first and second control signals based on the information indicative of the target state.

15 Claims, 4 Drawing Sheets

DRIVER CIRCUITS FOR SOLID STATE LIGHT BULB ASSEMBLIES

This application is a Continuation of PCT application no. PCT/EP2012/070217, which was filed on Oct. 11, 2012, and which is herein incorporated by reference in its entirety.

TECHNICAL FIELD

The present document relates to driver circuits for solid state light bulb assemblies and, in particular, for light bulb assemblies including light emitting diodes.

BACKGROUND

There is an increasing interest in electric light bulbs which do not make use of incandescent filaments, since filament-based light bulbs are considered to be inefficient and energy hungry. Indeed, recent legislative changes mean that traditional incandescent light bulbs are being phased out in many parts of the world. One existing replacement for the incandescent light bulb is the compact fluorescent tube bulb.

Solid state lighting (SSL), for example light emitting diode (LED) or organic light emitting diode (OLED) based retrofit lamps, offer superior performance over compact fluorescent lamp (CFL) based retrofit lamps in terms of efficiency, instant light output, light quality, and lifetime. The main barrier to penetrate the market is product cost, since the shop price of today's LED-based lamps can be up to 10 times of CFL lamps.

A key element of an LED lamp assembly is the LED light source. The luminous efficiency, measured in lumen per watt, has been improved significantly over the last 10 years, and continues to increase further to levels of 250 lm/W for white light LEDs, with potential for further improvement.

Another strong advantage of using LED light sources is that they offer superior lifetime since the only failure mode is a slow depreciation of the outcoupling optics of the light source.

SSL lamp assemblies are generally operated using mains or power line electrical supplies, which provide an AC voltage, typically having a level of 110/120V or 230V/240V, at frequencies of between 50 and 60 Hz. This alternating nature of supply voltage consequently causes the power into the SSL lamp assembly to be inherently time dependent. The power typically changes between zero and multiples of the average system power within one power cycle.

The SSL device needs to be supplied with a DC drive signal. Any fluctuation of the DC drive signal can lead to visible effects such as flickering and to a degradation of the SSL efficiency due to so called droop effects at increased current levels.

Whenever the instantaneous input power is higher than the instantaneous output power the excess power has to be stored inside the power converter. Whenever the instantaneous input power is lower than the instantaneous output power the missing power has to be delivered from inside the power converter. Therefore, power converters usually include an electrical storage element.

Electrical energy can be stored as current using inductors or as voltage using capacitors. To store electrical energy of reasonable amount in the time domain of higher than milliseconds, inductive storage elements tend to become extremely large and bulky. Power converters typically use capacitors for energy storage.

In one previously-considered design, a single stage is provided which includes one switching element. The switching element being a MOSFET or a bipolar device or any other device is capable of switching electrical magnitudes at reasonably high frequencies.

Typical example single stage converters include flyback converters, buck converters or buck/boost converters. If a single stage converter is used said capacitive storage element can be connected to either the input or the output of the converter.

If the storage element is placed at the input, mains current is drawn only in a very short period of time causing large distortion of mains current which has to be filtered to comply with legal standards. Further the capacitive storage element has to withstand very high voltages typically above the peak of the mains voltage at the typical ambient temperature that occurs inside the SSL lamp assembly.

Such capacitive storage elements are typically aluminum electrolytic capacitors with a wet electrolyte which tends to slowly evaporate or diffuse causing degradation of the device especially at increased temperature levels. Such devices are expensive, sensitive to lifetime limitations and bulky.

If the storage element is placed at the output of the power converter, it is inherently placed in parallel to the SSL device. SSL devices inherently produce a very low incremental resistance. Consequently the capacitance of the energy storing device must be very large in order to achieve reasonable filtering of the current fluctuation into the SSL device. Typically capacitances substantially higher than 100 uF are needed. In many cases capacitances at 1000 uF or higher are needed.

Such capacitive storage elements are typically aluminum electrolytic capacitors with a wet electrolyte which tends to slowly evaporate or diffuse causing degradation of the device especially at increased temperature levels. Such devices are expensive, sensitive to lifetime limitations and bulky.

One previously-considered power converter topology has a common reference potential of input, output and power switch. Such a topology offers the advantage of simple control but has a significant disadvantage in that the output voltage is higher than the input voltage. These topologies are also referred to as boost circuits. To be used inside an SSL lamp assembly the output voltages become higher than the peak mains voltage yielding output voltages as high as 400V and above. The required capacitors are bulky, costly and strongly limited in their lifetime under elevated temperature conditions.

SUMMARY

According to an aspect, a driver circuit for a solid state light source is described. The solid state light source may e.g. be an LED or OLED. The driver circuit typically comprises a power converter which is configured to convert electrical power from a so mains supply to electrical power for the light source. In particular, the power converter may be configured to convert a DC input voltage into a DC output voltage, wherein the DC output voltage typically corresponds to the on-voltage of the SSL source.

In particular, the driver circuit may comprise a multi-stage power converter. As such, the driver circuit may comprise a first power converter stage configured to convert an input voltage into an intermediate voltage (also referred to herein as the bus voltage). The input voltage may be a rectified version of the mains voltage. The first power converter stage may comprise a switched-mode power converter, e.g. a single-ended primary-inductor converter. Furthermore, the driver circuit may comprise a second power converter stage configured to convert the intermediate voltage into a drive voltage (e.g. the on-voltage) for the light source. The second power converter stage may be a switched-mode power converter, e.g. a flyback converter.

The first power converter stage may comprise an input connection for receiving the input voltage, an output connection for providing the intermediate voltage, and a switch device. The input connection, the output connection and the switch device may share a common reference potential, thereby allowing the use of (cost efficient) low side driver circuits for driving the switch device of the first power converter stage. The voltage at the input connection may be larger than the voltage at the output connection of the first power converter stage. Examples for the first power converter stage are a SEPIC converter, a flyback converter and/or a forward converter. In a similar manner, the second power converter stage may comprise an input connection for receiving the intermediate voltage, an output connection for providing the drive voltage, and a switch device. The input connection, the output connection and the switch device may share a common reference potential, thereby allowing the use of (cost efficient) low side driver circuits for driving the switch device of the second power converter stage.

The driver circuit may comprise a controller (e.g. a controller chip). The controller may comprise a first control unit (e.g. a SW component of the controller) configured to generate a first control signal for the first power converter stage. Furthermore, the controller may comprise a second control unit (e.g. a SW component of the controller) configured to generate a second control signal for the second power converter stage. As indicated above, the first and/or second power converter stages may comprise switched-mode power converters comprising respective switches. As such, the first and second control signals may comprise pulse width modulated control signals for controlling the respective switches (or switch devices).

The first and second control units may be configured to exchange control data indicative of the first and second control signals, respectively. By doing this, the controller (and in particular the first and second control units) may be configured to improve the performance of the driver circuit (notably with respect to convergence speed and/or stability).

The first control unit may be configured to generate the first control signal using a first control algorithm with a first set of coefficients. By way of example, the first control algorithm may comprise a PID control algorithm. The first set of coefficients may comprise a proportional gain, an integral gain and/or a derivative gain. In a similar manner, the second control unit may be configured to generate the second control signal using a second control algorithm with a second set of coefficients. By way of example, the second control algorithm may comprise a PID control algorithm. The second set of coefficients may comprise a proportional gain, an integral gain and/or a derivative gain.

The control data exchanged between the first and second control units may comprise the first and/or second sets of coefficients. As such, the second control unit may be configured to determine the second set of coefficients based on the set of coefficients used by the first control unit (or vice versa). In more general terms, the second control unit may be configured to generate the second control signal based on the control data indicative of the first control signal (or vice versa). As such, the first and second control units may be configured to determine the first and second sets of coefficients such that a trade-off between convergence speed and stability of the multi-stage power converter is increased.

The controller may comprise a state control unit configured to determine a target state (e.g. a target illumination state) of the light source. In particular, the state control unit may be configured to determine the target state from a current state using a state machine. The light bulb assembly (or the light source) may be operated in a plurality of different states, wherein the plurality of states is indicative of a plurality of corresponding different illumination levels of the light source. Alternatively so or in addition, one or more of the plurality of different states may be indicative of an internal state of the light bulb assembly. The state machine may comprise (or may define) the plurality of states indicative of the plurality of corresponding illumination levels of the light source, and a plurality of transitions between at least some of the plurality of states. The plurality of transitions is typically subjected to a respective plurality of events. In other words, a transition from a first state to a second state is typically triggered by the detection of a particular event. An event of the plurality of events may be defined by one or more conditions. The one or more conditions may comprise one or more of: a condition with respect to the temperature of the driver circuit, a condition with respect to a pre-determined time interval, and/or a condition with respect to the mains supply voltage.

The state control unit may be operable to determine a current state of the plurality of states. The current state is typically the state that the light source is currently operated in. By way of example, the current state may be indicative of the current illumination level of the light source. For this purpose, a state may comprise information regarding the amount of power which is supplied to the light source. The amount of power supplied to the light source may be indicative for the illumination level of the light source. The light bulb assembly specific relationship between the amount of supplied power and the actual illumination level may be determined in the context of an illumination calibration during the manufacturing process of the light bulb assembly.

The state control unit may be operable to detect an event, e.g. an event based on the temperature of the driver circuit or the light source. The event may be defined e.g. by the condition that the temperature exceeds or lies below a pre-determined temperature threshold. Furthermore, the state control unit may be operable to determine a target state of the plurality of states based on the state machine. By way of example, the state machine may be indicative of an event-dependent transition from the current state to the target state (e.g. the target illumination state).

The first and second control units may be configured to receive information indicative of the target state (e.g. the target illumination state). Furthermore, the first and second control units may be configured to generate the first and second control signals based on the information indicative of the target state. Furthermore, the first and second control units may take into consideration the current state (e.g. the current illumination state), in order to ensure a fast and/or stable control from the current state to the target state.

The controller may be configured to receive information indicative of a target dim level of the light source. The target dim level may be set by a dimmer (e.g. a phase-cut dimmer). As such, the information indicative of a target dim level may correspond to a conduction angle set by the phase-cut dimmer. Furthermore, the controller may be configured to receive information indicative of a type of dimmer used to set the target dim level (e.g. a leading edge phase cut dimmer or a tailing edge phase cut dimmer). The first and second control units may be configured to generate the first and second control signals based on the information indicative of the target dim level of the light source and/or based on the type of dimmer. In particular, the first and second control units may be configured to determine the first and/or second sets of coefficients of the first and/or second control algorithms, respectively, based on the information indicative of the target dim level of the light source and/or based on the type of dimmer. In other words, the first and/or second control unit may be configured to adapt the first and/or second control algorithms (in particular the coefficients of the first and/or second control algorithms) to the target dim level and/or to the type of dimmer. The sets of coefficients may be adapted in a dynamic manner based on the changes of the information indicative of the target dim level of the light source.

The controller may further comprise a central clock signal generator configured to generate a clock signal. The first and second control unit may be synchronized using the clock signal.

The controller may be configured to receive one or more feedback signals. The one or more feedback signals may comprise one or more of: a signal indicative of the input voltage, a signal indicative of the intermediate voltage, and/or a signal indicative of the drive voltage. The first and second control units may be configured to generate the first and second control signals also based on the one or more feedback signals. In particular, the first and second control units may be configured to determine the first and/or second sets of coefficients of the first and/or second control algorithms, respectively, based on the one or more feedback signals. In other words, the first and/or second control unit may be configured to adapt the first and/or second control algorithms (in particular the coefficients of the first and/or second control algorithms) in accordance to the one or more feedback signals.

The controller may be configured to receive information regarding the power drawn by the driver circuit (e.g. regarding the current drawn by the driver circuit). The first and second control units may be configured to generate the first and second control signals also based on the information regarding the power drawn by the driver circuit. In particular, the first and second control units may be configured to determine the first and/or second sets of coefficients of the first and/or second control algorithms, respectively, based on the information regarding the power drawn by the driver circuit. In other words, the first and/or second control unit may be configured to adapt the first and/or second control algorithms (in particular the coefficients of the first and/or second control algorithms) in accordance to the information regarding the power drawn by the driver circuit.

According to another aspect, a controller for a driver circuit comprising a multi-stage power converter is described. The controller may comprise any of the features and components described in the present document.

According to a further aspect, a light bulb assembly is described. The light bulb assembly may comprise housing, a solid state light emitting device located within the housing and an electrical connection module attached to the housing and adapted for connection to a mains supply. Furthermore, the light bulb assembly may comprise a driver circuit according to any of the aspects described in the present document. The driver circuit may be located within the housing, and may be connected to receive an electricity supply signal from the electrical connection module. Furthermore, the driver circuit may be operable to supply an electrical drive signal to the light emitting device.

According to one aspect, there is provided a driver circuit for a light bulb assembly which includes a solid state light emitting device and a driver circuit for supplying drive current to the light emitting device, the driver circuit comprising a power converter having first and second stages operable to supply drive current to a connected light emitting device, and a controller operable to supply control signals to the first and second stages, wherein one of the first and second stages is provided by a converter circuit which includes an input connection for receiving an input signal, an output connection for providing an output signal, and a switch device, the input connection, the output connection and the switch device sharing a common reference potential, wherein the converter circuit is operable to provide an output signal having a voltage lower than that of such an input signal.

According to another aspect, there is provided a light bulb assembly comprising a housing, a solid state light emitting device, located within the housing, an electrical connection module, attached to the housing, and adapted for connection to an electrical power source, and a driver circuit located within the housing, connected to receive an electrical supply signal from the electrical connection module, and operable to supply an electrical drive signal to the light emitting device, the driver so circuit comprising a power converter having first and second stages operable to supply drive current to a connected light emitting device, and a controller operable to supply control signals to the first and second stages, wherein one of the first and second stages is provided by a converter circuit which includes an input connection for receiving an input signal, an output connection for providing an output signal, and a switch device, the input connection, the output connection and the switch device sharing a common reference potential, and wherein the converter circuit is operable to provide an output signal having a voltage lower than that of such an input signal.

In one example, the converter circuit comprises an input connection defined between a reference potential and an input terminal, a first inductive energy storage element, and a first switch element connected in series between the input terminal and the reference potential, a capacitive energy storage element and a voltage resetting element connected in series between the first inductive energy storage element and the reference potential, in parallel with the first switch element, a second switch device connected to the capacitive energy storage element and to the voltage resetting element, and an output connection defined between the second switch device and the reference potential. In one particular example, the capacitive storage element has a voltage there-across during operation, and the voltage resetting element is operable to maintain that voltage substantially equal to an input voltage applied to the input connection.

In one example, the converter circuit comprises an input connection defined between a reference potential and an input terminal, a first inductive energy storage element, so and a first switch element connected in series between the input terminal and the reference potential, a capacitive energy storage element and a second inductive energy storage element connected in series between the first inductive energy storage element and the reference potential, in parallel with the first switch element, a second switch device connected to the capacitive energy storage element and to the second inductive energy storage element, and an output connection defined between the second switch device and the reference potential.

In one example, one of the first and second stages is provided by a single ended primary-inductor converter SEPIC circuit.

In one example, the power converter circuit comprises a first power converter stage connected to receive an electricity supply signal from the electrical connection module, and operable to draw electrical energy from the electrical connection module in dependence upon a first control signal received from the controller, a capacitive electrical energy storage device connected for reception of electrical energy from the first power converter stage, and a second power converter stage, connected to receive electrical energy from the first power converter stage and from the electrical energy storage device, and operable to output an electrical drive current to the solid state light emitting device in dependence upon a second control signal received from the controller.

In one example, the controller comprises a digital data processing device and a digital data storage device, the controller being operable to receive an input signal, to generate first and second control signals in dependence upon such an input signal in combination with behavior information stored in the data storage device, the behavior information relating to operating characteristics of a light emitting device under control, and to supply first and second control signals to the first and second power converter stages respectively for control thereof.

According to another aspect, there is provided a light bulb assembly comprising a housing, a solid state light emitting device, located within the housing, an electrical connection module, attached to the housing, and adapted for connection to an electrical power source, and a driver circuit located within the housing, connected to receive an electrical supply signal from the electrical connection module, and operable to supply an electrical drive signal to the light emitting device, the driver circuit comprising a power converter having first and second stages operable to supply drive current to a connected light emitting device, and a controller operable to supply control signals to the first and second stages, wherein one of the first and second stages is provided by a converter circuit which includes an input connection for receiving an input signal, an output connection for providing an output signal, and a switch device, the input connection, the output connection and the switch device sharing a common reference potential, and wherein the converter circuit is operable to provide an output signal having a voltage lower than that of such an input signal.

In one example a two stage power converter is provided. Within a two stage power converter a third option to place a storage element is introduced by placing the said storage element at the output of the first converter stage. The average voltage level as well as the amount of fluctuation can be chosen to optimize cost, size and lifetime of the storage element and is entirely decoupled from requirements resulting from the SSL device operation or meeting certain mains quality targets defined by standards or de factor market standards.

In another example, a dual stage power supply for SSL lamp assemblies is characterized in that the storage element is connected between the first and second stage and the average voltage across the devices is chosen to optimize the cost/performance/size ratio of the device and the fluctuation can be set such that the required capacitance value is minimized.

In another example, the capacitive storage element which is connected between the first and the second power stage is a ceramic capacitor. In example, the capacitor is a multi-layer ceramic capacitor. In one further example, the capacitor is a plastic film capacitor.

In another example, a second power converter stage has a safety isolation barrier in order to have the output voltage of that second stage being isolated against mains voltage according to global safety regulations—for example the safety electronic low voltage (SELV) regulation.

Multi converter stages tend to have a higher component count but the individual components can be designed smaller due to lower electrical magnitudes and less stress conditions compared to single stage converters.

In one example, a two stage power converter architecture is provided, the architecture being characterized in that all involved power switches are ground related and hence can be controlled by a control IC device which operates related to the same ground potential and hence no additional circuitry is needed for driving a power switch on a reference potential other than the common ground potential.

In one example, a capacitive storage element is provided inside the first converter stage, connected between the inductive storage element and the output voltage. In an example, also a rectifying element is connected in series with this additional capacitor. By keeping the additional capacitor charged to a defined voltage level maintains the output voltage below the input voltage and hence being appropriate to be used as the supply voltage for SSL devices. The additional capacitive storage element does not contribute to the energy transfer but rather holds the voltage constant within one high frequency cycle which is typically below 100 μs. Hence the capacitor can be designed to be small in size, low cost and having no substantial lifetime limitation. In order to maintain the voltage of the additional storage element on a defined level a voltage resetting element is needed. In one example this resetting element is an inductor connected between the additional capacitive element and the reference potential.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

DETAILED DESCRIPTION

In the current context a light bulb "assembly" includes all of the components required to replace a traditional incandescent filament-based light bulb. As will become clear from the description of the examples given below, the teachings of the present document are applicable to light bulb assemblies for connection to the standard electricity supply. In British English, this electricity supply is known as "mains" electricity. Whilst in US English, this supply is known as "power line". Other terms include "AC power", "line power", "domestic power" and "grid power". It is to be understood that these terms are readily interchangeable, and carry the same meaning.

Typically, in Europe electricity is supplied at 230-240 VACS, at 50 Hz and in North America at 110-120 VACS at 60 Hz. The principles set out below apply to any suitable electricity supply, including the main/power line mentioned, and a DC power supply, and a rectified AC power supply.

Figure 1:
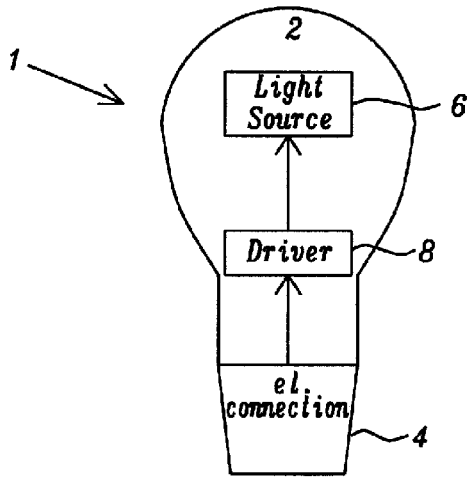
FIG. 1 is a schematic view of a light bulb assembly.

FIG. 1 is a schematic view of a light bulb assembly. The assembly 1 comprises a bulb housing 2 and an electrical connection module 4. The electrical connection module 4 can be of a screw type or of a bayonet type, or of any other suitable connection to a light bulb socket. A solid state light source 6, preferably a light emitting diode (LED), is provided within the housing 2. The light source 6 may be provided by a single light emitting device, or by a plurality of such devices.

Drive circuitry 8 is located within the bulb housing 2, and serves to convert supply electricity received through the electrical connection module 4 into a controlled drive current for the solid state light source 6.

The housing 2 provides a suitably robust enclosure for the light source and drive components, and includes optical elements that a required for providing the desired output light from the assembly. The housing 2 also provides a heat-sink capability, since management of the temperature of the light source is very important in maximizing light output and light source life. Accordingly, the housing is designed to enable heat generated by the light source to be conducted away from the light source, and out of the assembly as a whole. One complication of the housing design is that, for consumer products, the outer temperature of the housing must be suitably low to prevent injury to a user. These requirements can lead to housing designs that are complex to manufacture. Accordingly, careful and accurate management of the thermal characteristics of the light bulb is desirable.

Figure 2:
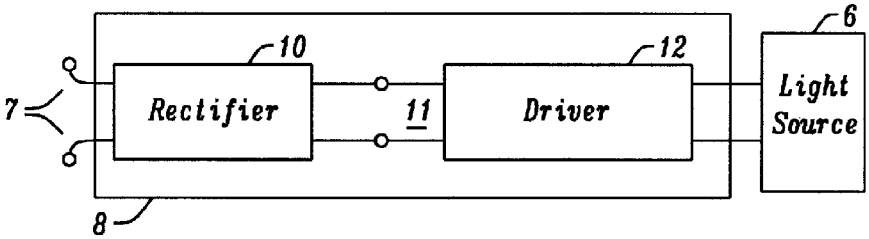
FIG. 2 is a schematic block diagram of drive circuitry of the assembly of FIG. 1.

FIG. 2 illustrates the drive circuitry 8 and light source 6 of FIG. 1 in more detail. The drive circuitry 8 comprises a rectifier 10 which receives alternating current (AC) supply electricity, and delivers a rectified current (DC) 11 at its output. This DC power is received by a driver 12 which serves to output a controlled DC drive signal to provide electrical power to the light source 6. The voltage and current characteristics of the output drive signal from the driver 12 are determined by the type and number of light emitting devices employed in the light source 6. The power supplied to the light source 6 is controlled in dependence upon desired operating conditions of the light source 6. In one example, the light source includes a plurality of light emitting devices, and requires a drive signal having a voltage of 50V or more. In general, the drive signal may be in the range of 10V to over 100V.

Figure 3:
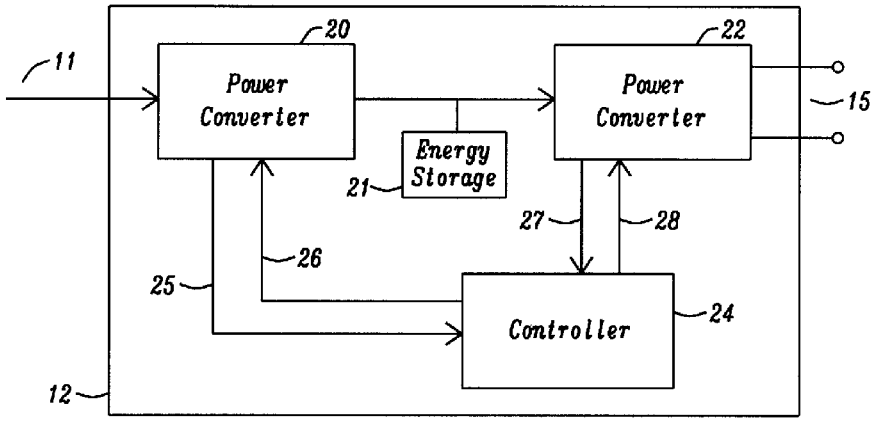
FIG. 3 is a schematic block diagram of a second example driver for use in the circuitry of FIG. 2.

FIG. 3 illustrates a first example driver 12 suitable for use in the drive circuitry 8 of FIG. 2. The first driver 12 comprises first and second power converter stages 20 and 22 which are controlled by a controller 24. In this example, the first power converter stage 20 receives DC power 11 from the rectifier 10, and operates to convert that power signal to an intermediate signal having desired power, voltage and current characteristics. The intermediate signal is supplied to the second power converter stage 22, for conversion into a controlled output drive signal 15 for supply to the light source 6. It will be appreciated that the rectifier 10 may be replaced by a remotely located rectifier that supplies rectified AC power to the light bulb assembly, or by a DC power source such as a battery.

A capacitive electrical energy storage device 21 is located between the first and second power converter stages 20 and 22. The energy storage device 21 receives electrical energy from the first power converter stage 20, and provides energy to the second power converter stage 22. The energy storage device 21 serves to overcome the fluctuations in available power caused by the alternating current characteristics of the input electricity supply signal.

Each power converter stage 20 and 22 comprises at least one inductive energy storage device, and at least one switch device. The switch device is controlled by the controller 16, and may be provided by a metal oxide semiconductor field effect transistor (MOSFET) device, or other device suitable for switching high voltage (for example, hundreds of volts).

In an example, one of the first and second power converter stages 20 and 22 is provided by a converter circuit having input and output connections and a switch device that share a common ground or reference potential, and which enables the voltage at the output connection to be lower than that at the input connection. An example of such a circuit is a SEPIC (single-ended primary inductor converter) circuit, and will be described below. The other of the stages may be provided by any suitable circuit topology. For example, a buck converter circuit, a boost converter circuit, a buck/boost converter circuit, another SEPIC circuit, or a flyback converter circuit could be used for the other power converter stage. Some combinations of circuit topologies will be more suitable than others.

The controller 24 receives respective sensor or feedback signals 25 and 27 relating to the operation of the power converter stages 20 and 22 and/or to the operation of the light source 6, and supplies respective control signals 26 and 28 to the first and second power converter stage 20 and 22 in order that the drive signal 15 is appropriate to the desired operation of the light source 6. Operation of the controller will be explained in more detail below.

Figure 4:
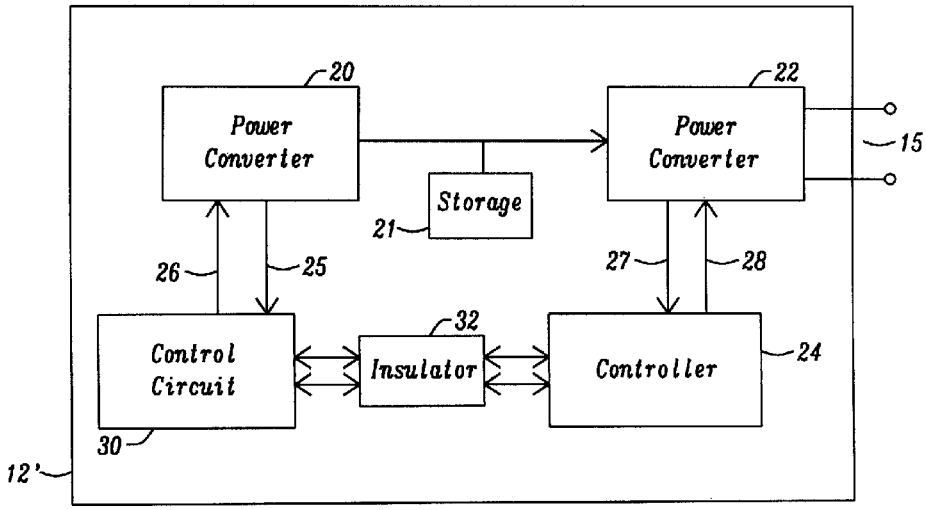
FIG. 4 is a schematic block diagram of a third example driver for use in the circuitry of FIG. 2.

FIG. 4 illustrates a second example driver 12' suitable for use in the drive circuitry 8 of FIG. 2. The second driver 12' is similar to the first driver 12 of FIG. 5, and comprises first and second power converter stages 20 and 22 which are controlled by a controller 24. The first power converter stage 20 receives DC power 11 from a suitable source, such as the rectifier 10, and operates to convert that power signal to an intermediate signal having desired power, voltage and current characteristics. The intermediate signal is supplied to the second power converter stage 22, for is conversion into a controlled output drive signal 15 for supply to the light source 6.

As in the previous example, a capacitive electrical energy storage device 21 is located between the first and second power converter stages 20 and 21. The energy storage device 21 receives electrical energy from the first power converter stage 20, and provides energy to the second power converter stage 22. The energy storage device 21 serves to overcome the fluctuations in available power caused by the alternating current characteristics of the input electricity supply signal.

Each power converter stage 20 and 22 comprises at least one inductive energy storage device, and at least one switch device. The switch device is controlled by the controller 24, and may be provided by a metal oxide semiconductor field effect transistor (MOSFET) device, or other device suitable for switching high voltage.

As before, one of the first and second power converter stages 20 and 22 is provided by a circuit having an input connection, an output connection, and a switch device that share a common ground or reference potential, and which is able to provide an output voltage lower than the input voltage, such as a SEPIC (single ended primary-inductor converter) circuit. The other of the stages may be provided by any suitable circuit topology. For example, a buck converter circuit, a boost converter circuit, a buck/boost converter circuit, another SEPIC circuit, or a flyback converter circuit could be used for the other power converter stage. Some combinations of circuit topologies will be more suitable than others.

The controller 24 receives respective sensor or feedback signals 25 and 27 relating to the operation of the power converter stages 20 and 22 and/or to the operation of the light source 6, and supplies respective control signals 26 and 28 to the first and second power converter stage 20 and 22 in order that the drive signal 15 is appropriate to the desired operation of the light source 6. Operation of the controller will be explained in more detail below.

The second driver 12' also includes a secondary control circuit 30 and an isolator 32. The secondary control circuit 30 is operable to receive sensor/feedback signals 25 from the first power converter stage 20, and to pass those signals to the controller 24 via the isolator 32. Similarly, the controller 24 is operable to pass control signals to the secondary control circuit 30 via the isolator 32, for provision to the first power converter stage 20. The isolator 32 serves to isolate the first power converter stage 20 from the controller 24, in the situation where the power converter stage and the controller operate at different voltage levels.

Figure 5:
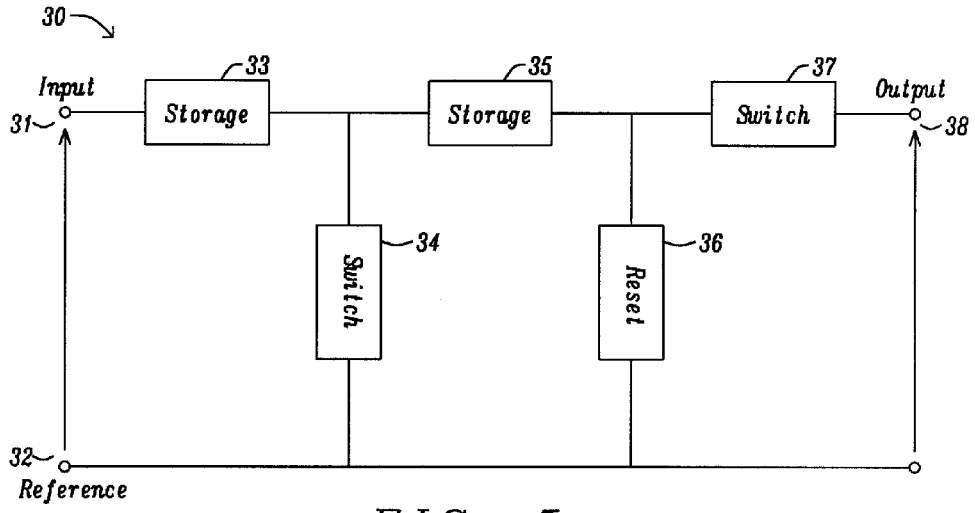
FIG. 5 is a schematic block diagram of an example of a power converter circuit.

A SEPIC (single-ended primary-inductor converter) circuit is a configuration of DC to DC power converter circuit in which the input and the output signals have a common ground or reference potential. One example of a SEPIC circuit 30 is shown in FIG. 5, and includes an input connection, provided between an input terminal 31 and a reference (for example ground) potential 32. A first inductive energy storage element 33 and a first switch 34 are connected in series between the input terminal 31 and reference potential 32. A capacitive energy storage element 35 and a voltage resetting element 36 are connected in series between the first inductive storage element 33 and reference potential 32, in parallel with the first switch 34. The voltage resetting element 36 may operate to maintain the voltage across the capacitive energy storage element 35 substantially equal to the input voltage received at the input connection. The voltage resetting element may be provided by a second inductive energy storage element.

A second switch 37 is connected between the capacitive storage element 35 and an output terminal 38. The output terminal 38 provides an output connection of the circuit having the same reference potential 32 as the input connection. The voltage resetting element 36 may be provided by an inductor, or by an inductor/diode combination, or by any suitable component.

The first switch device 34 is connected such that the input voltage is applied to the first inductive storage element 33 when the switch 34 is in its on condition. The first switch device 34 can be provided by any suitable switch device such as a MOSFET or bipolar transistor.

The capacitive storage device 35 operates such that the change in voltage within one switching cycle of the switch devices is significantly smaller than the voltage that is stored by the capacitive storage device 35. In addition, the average voltage across the storage device 35 is substantially equal to the input voltage.

The second switch device 37 is connected such that in its on state the voltage applied across the first inductive storage element 33 is the linear sum of the input voltage, the output voltage and the voltage across the capacitive storage element. The voltage across the capacitive storage device 35 determines the current flow with respect to the first inductive storage element 33. The second switching device 37 can be provided by any suitable switching device, such as a diode.

The important characteristics of the SEPIC circuit of FIG. 5 are that the input and output connections and first switch device share a common reference potential, and that the circuit is operable to produce an output lower in voltage than the input.

Figure 6:
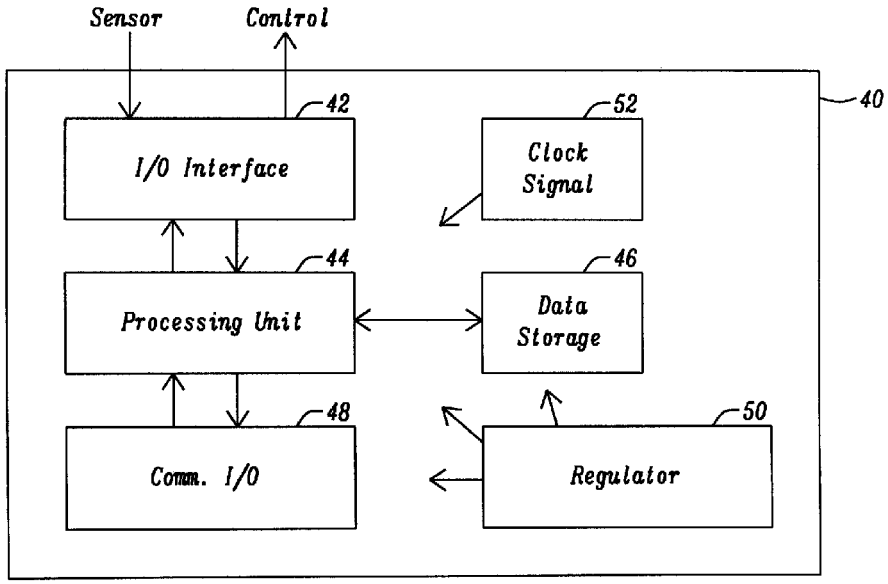
FIG. 6 is a schematic block diagram of an example controller for use in the driver of FIG. 3, or 4.

FIG. 6 illustrates one possible example of a controller 40 suitable for use in the driver of FIG. 3 or 4. The controller 40 includes input/output interface unit 42 for receiving sensor/feedback signals S and for outputting control signals C, a processing unit 44 for overall control of the system, and a data storage device 46 for storing data for use by the processing device. A communications input/output device 48 may be provided for enabling the processing unit 44 to communicate with other devices, for example using a suitable wired or wireless communications protocol. The controller 40 also incorporates a power supply regulator 50, which supplies power to the devices within the controller 40, and a clock signal generator 52 (such as an oscillator circuit) for supplying a reference clock signal to the processing unit 44.

The processing unit 44 operates to generate the control signals C for controlling the switch device or devices in the power converter. Typically, the control signals will be pulse width modulated signals that control the duty cycle (that is, the ratio of 'on' to 'off') of the switch device in the power converter, and hence control the output drive signal 15. The processing unit combines received signals relating to the operating conditions of the power converter and/or the light source with behavior information stored as data in the data storage device 46. The processing unit 44 uses information relating for the input signals in combination with the stored behavior information to determine the correct control signal values for output to the power converter.

In the FIG. 6 example, the processing unit 44 is programmable by virtue of the provision of the data storage device 46. The data storage device may be provided by a fuse array, a one-time programmable (OTP) device, a flash memory device, or any other non-volatile memory device. The device may be reprogrammable, or may be programmable once during manufacture of the light bulb assembly. The provision of a programmable data storage device that enables the functionality of the processing unit to change in dependence with the operating characteristics of the power converter and/or light source allows a single driver circuit to be used with a range of different light bulb assemblies.

The sensor/feedback signals are representative of the operation state of the power converter and/or of the light source. For example, the signals may represent any voltage or current level within the power converter or light source. Alternatively, or additionally, the signals may relate to at least one temperature, an output light level, an output light frequency, a magnitude of output light at a particular wavelength or range of wavelengths, a presence detection signal, an infra-red level, and/or an ambient light level.

The input/output interface unit 42 include analogue to digital conversion for providing digital information to the processing unit 44.

The controller provided in such a driver is able to be a standard component, which results in lower manufacturing cost of the control unit, and hence of the driver. In addition, the physical size of the control unit, and driver can be optimized, so that the driver can be used in a wide range of light bulb applications of varying sizes.

The programmable control unit is able to provide the driver with a desirable range of features, such as dimming, without the need to provide a different driver circuit for each type of light bulb. In one example, the controller is implemented on a single integrated circuit, for example using a CMOS (complementary metal oxide semiconductor) sub 0.35 um process.

Figure 7:
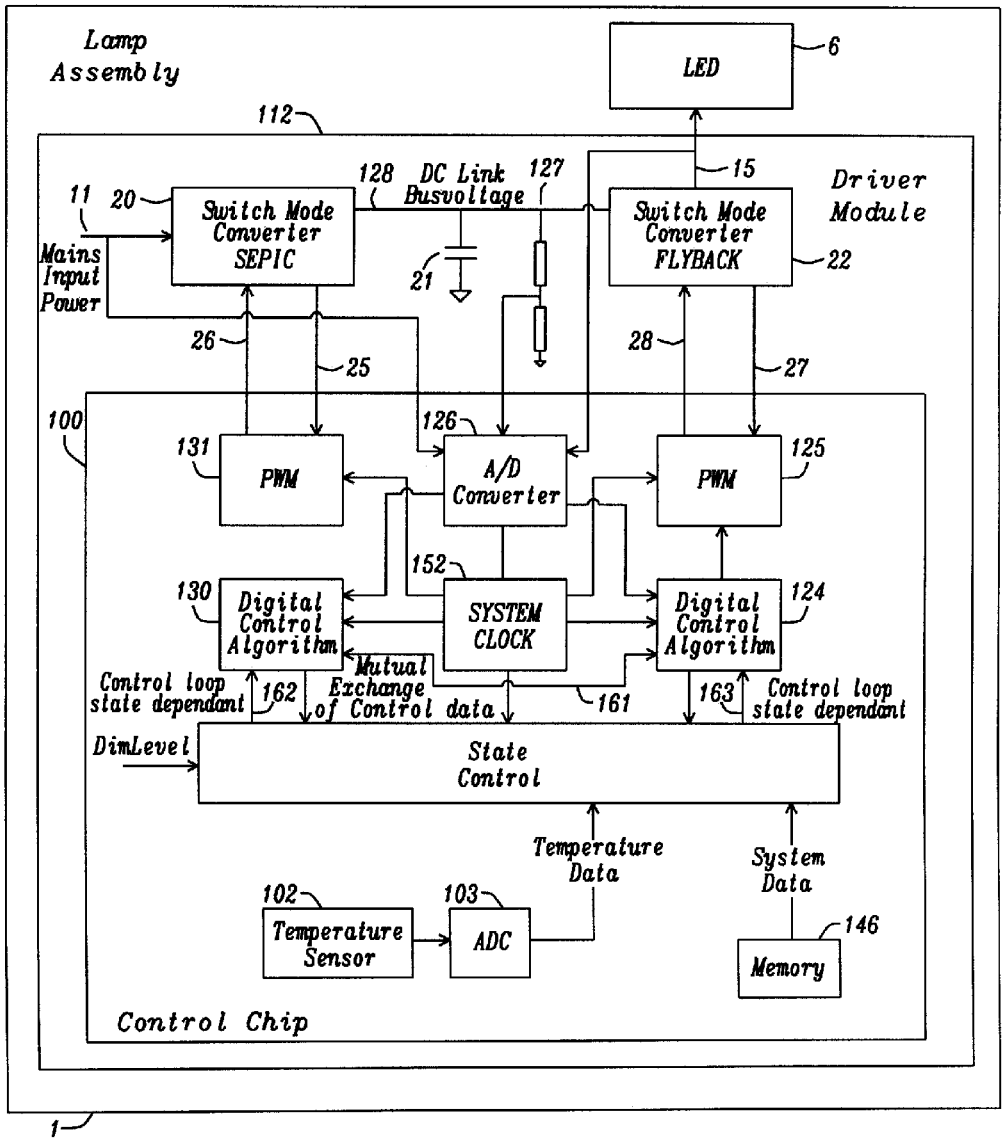
FIG. 7 is a schematic block diagram of an example lamp assembly comprising a multi-stage power converter.

FIG. 7 shows a block diagram of an example light bulb assembly 1 comprising a driver circuit 112 (e.g. the driver circuit 12 or 12') which itself comprises a controller (e.g. a controller chip) 100 (e.g. the controller 24 or 30). The driver circuit 112 so comprises a two-stage power converter with a first converter stage 20 and a second converter stage 22. In the illustrated example, the first converter stage 20 is a SEPIC converter and the second converter stage 22 is a flyback converter. The two converter stages 20, 22 are controlled using respective control units 130, 124 and respective PWM (pulse width modulation) generation units 131, 125. The components of the controller 100 are clocked using a single central clock signal generator 152, thereby ensuring that the different components of the controller 100 (notably the control units 130, 124 and the PWM generation units 131, 125) operate in a synchronized manner.

The controller 100 may receive one or more analogue electrical signals from the driver circuit 112, which may be used as feedback signals for the control of the converter stages 20, 22. In particular, the controller 100 may receive a voltage derived from the mains input voltage (e.g. a voltage proportional to the rectified input voltage 11), a voltage derived from the bus voltage 128 (e.g. using the voltage divider 127) and/or a voltage derived from the drive voltage 15. The controller 100 may comprise an analogue-to-digital (A/D) converter 126 for converting the one or more electrical feedback signals from the driver circuit 112 into digital signals. The feedback signals may be used by the control units 130, 124 for controlling the converter stages 20, 22.

The controller 100 may further comprise a state control unit 101 (e.g. the processing unit 44). The state control unit 101 may receive temperature information from a temperature sensor 102 (via an A/D converter 103) and system state data from the memory unit 146 (e.g. the data storage unit 46). The system state data may describe a state machine for the light bulb assembly 1. Each state of the state machine may be associated with (e.g. characterized by) temperature events (or other events) to which the state is sensitive. Furthermore, the state machine may be associated with (e.g. characterized by) a subsequent state which is entered upon occurrence of the respective event.

In other words, the state machine may comprise a plurality of states (e.g. illumination states) which may indicate respective pre-determined dim levels. In particular, a state of the plurality of states may be indicative of one or more settings for the power converter stages 20, 22 (which are associated with a respective dim level of the LED 6). In yet other words, the state may be indicative of the power which is provided to the LED 6 (which is associated with a respective dim level or illumination level of the LED 6). Furthermore, the state machine may define one or more events which may trigger a transition between different states of the state machine. By way of example, a particular value of the estimate of the temperature of the LED 6 may lead to a transition between different states. Possible events are e.g.: the crossing of temperature thresholds, timeout events, and user generated events, events detected at the input mains voltage (i.e. at the mains supply) such as a particular phase-cut angle of the input mains voltage.

A state machine may comprise a plurality of stages, wherein each state is associated with a corresponding illumination level of the LED 6, e.g. a maximum (e.g. 100%) illumination level of the LED, an intermediate (e.g. 50%) illumination level of the LED, a further intermediate (e.g. 10%) illumination level of the LED, and/or a minimum (e.g. 0%) illumination level of the LED (e.g. "off"). Each state may be defined by respective LED power values, i.e. by an amount of power which is to be provided to the LED 6.

Furthermore, the state machine may comprise a plurality of events. The events may be defined by one or more conditions, e.g. conditions with regards to the temperature measured by the temperature sensor 102 (which may correspond to the temperature of the controller chip 100, in case of an on-chip temperature sensor 102). A first event may be defined by the condition that the temperature lies below a first threshold T1, a second event may be defined by the condition that the temperature lies below a second threshold T2 but lies at or above T1, a third event may be defined by the condition that the temperature lies below a fifth T3 but lies at or above T2, and a fourth event may be defined by the condition that the temperature lies at or above T3.

Alternatively or in addition, an event may be defined by a condition which relates to a transition of the temperature moving from a temperature below one of the thresholds T1, T2, T3 to a temperature at or above the one of the thresholds T1, T2, T3 (or vice versa). In other words, the event or the condition defining the event may relate to the crossing of one of the thresholds T1, T2, T3 in either direction.

Using the above states and events, the state machine may define transitions from a current state to a target state, subject to the detection of an event. The state machine may make use of a hysteresis for the transitions between the different states. The hysteresis typically requires a lower temperature for a transition from a lower level illumination state to a higher level illumination state than for the inverse transition. By doing this, the stability of the state machine can be improved. In particular, oscillations between states can be avoided.

As outlined above, the present document proposes the use of a dual stage switch mode power converter using e.g. a combined SEPIC/FLYBACK topology controlled by a synchronous digital controller 100. The advantages of the proposed converter architecture are a relatively low DC link bus voltage 128 and a relatively high dynamic range of the DC link bus voltage 128 at the link between the first and second converter stages 20, 22. The use of a two-stage power converter allows for an operation with no or limited inrush current. Furthermore, the use of a control loop set to appropriate coefficients allows for a relatively high power factor. The use of a digital controller comprising control units 130, 124 allows for programmability. In particular, it is possible to adapt control coefficients of the control algorithms used within the control units 130, 124 to the state of the light source 6. A further advantage is that the proposed converter architecture supports a powerless bleed current, thereby enabling an efficient use of the converter in conjunction with a dimmer.

The controller 100 of FIG. 7 comprises a central clock oscillator 152 (e.g. the clock signal generator 52) and a system state machine 101. All blocks of the controller 100 operate on the common clock generated by the central clock oscillator 152 (also referred to as the clock signal generator) as a fully synchronous system. Input voltage 11, DC Link bus voltage 128 and LED voltage 15 may be sensed using a common A/D converter unit 126 as feedback and control inputs.

The controller 100 may be configured to receive information regarding a desired dim level 166 set at the mains power supply (using e.g. a phase-cut dimmer). For detecting a desired dim level 166, the driver circuit 112 may comprise a dim level detection unit which determines the desired dim level 166 from the main voltage. Alternatively or in addition, the desired dim level 166 may be a function of time or may be received via an external interface (e.g. via a wireless interface). In other words, a dim level is setting the output power as function of time, of phase cut information or coming from an external interface (wireless).

The state control unit 101 may be configured to adjust the control algorithms which are performed within the control units 130, 124 as a function of the desired dim level 166, as a function of time (start-up of the light bulb assembly or normal operation of the light bulb assembly) and/or as a function of the mains power supply (e.g. mains power supplied via a phase-cut angle dimmer such as Phase Cut Mode Leading Edge or Phase Cut Mode Trailing Edge; or Normal Mains Mode). The operating parameters and/or the state information may be stored in the memory unit 146 (which may e.g. be a One-Time Programmable, OTP, memory).

As illustrated in FIGS. 7 and 4, the control units 130, 124 (or 30 and 24) may exchange information regarding the control signals used for the respective other converter stage 20, 24. By doing this, the stability of the two stage power converter so may be ensured. As shown in FIG. 7, the first control unit 130 of the first converter stage 20 may receive state information 162 from the state control unit 101, control data 161 from the second control unit 124, a clock signal from the clock signal generator 152 and/or one or more feedback signals (e.g. regarding the mains voltage 11, the bus voltage 128 and/or the drive voltage 15) from the driver circuit 112 (via the A/D converter 126). The first control unit 130 may be configured to determine a first control algorithm (e.g. the coefficients of a first control algorithm) used for controlling the first converter stage 20 based on some or all of the received information. In particular, the first control algorithm may be determined based on the control data 161 used in the second control unit 124.

In a similar manner, the second control unit 124 may receive state information 163 from the state control unit 101, control data 161 from the first control unit 130, the clock signal from the clock signal generator 152 and/or one or more feedback signals (e.g. regarding the mains voltage, the bus voltage and/or the drive voltage) from the driver circuit 112 (via the A/D converter 126). The second control unit 124 may be configured to determine a second control algorithm (e.g. the coefficients of the second control algorithm) used for controlling the second converter stage 22 based on some or all of the received information. In particular, the second control algorithm may be determined based on the control data 161 used in the first control unit 130.

By way of example, subject to a change of the illumination state (e.g. from 10% illumination to 50% illumination), the first and/or second control algorithms may be modified in order to avoid a momentary drop of the DC link bus voltage 128, in response to the load transient caused by the change of the illumination state. In particular, a convergence rate of the first and/or second control algorithms may be (momentarily) increased, in order to allow for an increased convergence speed in response to the load transient. After convergence to the new illumination state, the convergence rate may be decreased again, thereby favoring a precision and/or stability of the first and/or second control algorithms.

The first and second control algorithms may be described by respective first and second control functions H (e (n)), wherein e (n) is an error term which is to be reduced or minimized by the control algorithm (and wherein n indicates a sample number). By way of example, the first control stage 20 may be operated such that the bus voltage 128 at the output of the first controller stage 20 corresponds to a target bus voltage. The error term for the first control function may be the difference between the bus voltage and the target bus voltage. In a similar manner, the second control stage 22 may be operated such that the drive voltage 15 corresponds to the on-voltage of the light source 6. The error term for the second control algorithm may be the difference between the drive voltage 15 and the on-voltage of the light source 6.

The first and second control functions H (e (n)) may comprise a first and second set of coefficients. By way of example, the first and second control functions H (e (n)) may correspond to PID control functions with $$H(e) - a \times e(n) + b \times \int e(n)dn + c \times \frac{de(n)}{dn},$$

with the set of coefficients a (the so called proportional gain), b (the so called integral gain) and c (the so called derivative gain). The PID control function is only one possible example of the first and second control functions H (e (n)). Other examples comprise e.g. polynomials of a pre-determined order. The set of coefficients may be tuned, thereby tuning the convergence speed, the extent of overshoots, the stability and/or the convergence precision.

When using a two-stage power converter, the set of coefficients which is used for the first converter stage 20 may impact the set of coefficients which is used for the second converter stage 22, and vice versa. By way of example, the second control unit 124 may select a second set of coefficients which favors stability and/or precision over extent of overshoot and/or convergence speed, subject to the first control unit 124 using a first set of coefficients which favors extent of overshoot and/or convergence speed over stability and/or precision. As such, the joint selection of sets of coefficients for the control algorithms for the first and second converter stages 20, 22 leads to an improved speed/stability tradeoff for the overall power converter.

In the present document, a multi-stage power converter for an SSL source has been described. In particular, a controller for a multi-stage power converter has been described, which allows improving the performance of the multi-stage power converter by making the control of the different converter stages dependent on the control of the respective other converter stages.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

Particular aspects of the present document are:

Aspect 1. A driver circuit for a light bulb assembly which includes a solid state light emitting device and a driver circuit for supplying drive current to the light emitting device, the driver circuit comprising a power converter having first and second stages operable to supply drive current to a connected light emitting device, and a controller operable to supply control signals to the first and second stages, wherein one of the first and second stages is provided by a converter circuit which includes an input connection for receiving an input signal, an output connection for providing an output signal, and a switch device, the input connection, the output connection and the switch device sharing a common reference potential, wherein the converter circuit is operable to provide an output signal having a voltage lower than that of such an input signal.

Aspect 2. A driver circuit according to aspect 1, wherein the converter circuit comprises: an input connection defined between a reference potential and an input terminal; a first inductive energy storage element, and a first switch element connected in series between the input terminal and the reference potential; a capacitive energy storage element and a voltage resetting element connected in series between the first inductive energy storage element and the reference potential, in parallel with the first switch element; a second switch device connected to the capacitive energy storage element and to the voltage resetting element; and an output connection defined between the second switch device and the reference potential.

Aspect 3. A driver circuit according to aspect 1, wherein the converter circuit comprises: an input connection defined between a reference potential and an input terminal; a first inductive energy storage element, and a first switch element connected in series between the input terminal and the reference potential; a capacitive energy storage element and a second inductive energy storage element connected in series between the first inductive energy storage element and the reference potential, in parallel with the first switch element; a second switch device connected to the capacitive energy storage element and to the second inductive energy storage element; and an output connection defined between the second switch device and the reference potential.

Aspect 4. A driver circuit according to aspect 1, wherein the converter circuit comprises: an input connection defined between a reference potential and an input terminal; a first inductive energy storage element, and a first switch element connected in series between the input terminal and the reference potential; a capacitive energy storage element and a voltage resetting element connected in series between the first inductive energy storage element and the reference potential, in parallel with the first switch element; a second switch device connected to the capacitive energy storage element and to the voltage resetting element; and an output connection defined between the second switch device and the reference potential, and wherein the capacitive storage element has a voltage there-across during operation, and the voltage resetting element is operable to maintain that voltage substantially equal to an input voltage applied to the input connection.

Aspect 5. A driver circuit according to aspect 1, wherein one of the first and second stages is provided by a single-ended primary-inductor converter SEPIC circuit.

Aspect 6. A driver circuit according to aspect 1, wherein the power converter circuit comprises: a first power converter stage connected to receive an electricity supply signal from the electrical connection module, and operable to draw electrical energy from the electrical connection module in dependence upon a first control signal received from the controller; a capacitive electrical energy storage device connected for reception of electrical energy from the first power converter stage; and a second power converter stage, connected to receive electrical energy from the first power converter stage and from the electrical energy storage device, and operable to output an electrical drive current to the solid state light emitting device in dependence upon a second control signal received from the controller.

Aspect 7. A driver circuit according to aspect 1, wherein the controller comprises a digital data processing device and a digital data storage device, the controller being operable to receive an input signal, to generate first and second control signals in is dependence upon such an input signal in combination with behavior information stored in the data storage device, the behavior information relating to operating characteristics of a light emitting device under control, and to supply first and second control signals to the first and second power converter stages respectively for control thereof.

Aspect 8. A light bulb assembly comprising:

a housing;

a solid state light emitting device, located within the housing;

an electrical connection module, attached to the housing, and adapted for connection to an electrical power source; and a driver circuit located within the housing, connected to receive an electrical supply signal from the electrical connection module, and operable to supply an electrical drive signal to the light emitting device, the driver circuit comprising a power converter having first and second stages operable to supply drive current to a connected light emitting device, and a controller operable to supply control signals to the first and second stages, wherein one of the first and second stages is provided by a converter circuit which includes an input connection for receiving an input signal, an output connection for providing an output signal, and a switch device, the input connection, the output connection and the switch device sharing a common reference potential, and wherein the converter circuit is operable to provide an output signal having a voltage lower than that of such an input signal.

Aspect 9. A light bulb assembly according to aspect 8, wherein the converter circuit comprises:

an input connection defined between a reference potential and an input terminal; a first inductive energy storage element, and a first switch element connected in series between the input terminal and the reference potential;

a capacitive energy storage element and a voltage resetting element connected in series between the first inductive energy storage element and the reference potential, in parallel with the first switch element;

a second switch device connected to the capacitive energy storage element and to the voltage resetting element; and an output connection defined between the second switch device and the reference potential.

Aspect 10. A light bulb assembly according to aspect 8, wherein the converter circuit comprises:

an input connection defined between a reference potential and an input terminal;

a first inductive energy storage element, and a first switch element connected in series between the input terminal and the reference potential;

a capacitive energy storage element and a voltage resetting element connected in series between the first inductive energy storage element and the reference potential, in parallel with the first switch element;

a second switch device connected to the capacitive energy storage element and to the voltage resetting element; and an output connection defined between the second switch device and the reference potential, and wherein the capacitive storage element has a voltage there-across during operation, and the voltage resetting element is operable to maintain that voltage substantially equal to an input voltage applied to the input connection.

Aspect 11. A light bulb assembly according to aspect 8, wherein the converter circuit comprises:

an input connection defined between a reference potential and an input terminal;

a first inductive energy storage element, and a first switch element connected in series between the input terminal and the reference potential;

a capacitive energy storage element and a second inductive energy storage element connected in series between the first inductive energy storage element and the reference potential, in parallel with the first switch element;

a second switch device connected to the capacitive energy storage element and to the second inductive energy storage element; and an output connection defined between the second switch device and the reference potential.

Aspect 12. A light bulb assembly according to aspect 8, wherein one of the first and second stages is provided by a single-ended primary-inductor converter SEPIC circuit.

Aspect 13. A light bulb assembly according to aspect 8, wherein the power converter circuit comprises:

a first power converter stage connected to receive an electricity supply signal from the electrical connection module, and operable to draw electrical energy from the electrical connection module in dependence upon a first control signal received from the controller;

a capacitive electrical energy storage device connected for reception of electrical energy from the first power converter stage; and a second power converter stage, connected to receive electrical energy from the first power converter stage and from the electrical energy storage device, and operable to output an electrical drive current to the solid state light emitting device in dependence upon a second control signal received from the controller.

Aspect 14. A light bulb assembly according to aspect 8, wherein the controller comprises a digital data processing device and a digital data storage device, the controller being operable to receive an input signal, to generate first and second control signals in dependence upon such an input signal in combination with behavior information stored in the data storage device, the behavior information relating to operating characteristics of a light emitting device under control, and to supply first so and second control signals to the first and second power converter stages respectively for control thereof.

What is claimed is:

1. A driver circuit for a solid state light source, the driver circuit comprising a first power converter stage configured to convert an input voltage into an intermediate voltage;

a second power converter stage configured to convert the intermediate voltage into a drive voltage for the light source; and a controller comprising a first control unit configured to generate a first control signal for the first power converter stage;

a second control unit configured to generate a second control signal for the second power converter stage; and a state control unit configured to determine a target state of the light source; wherein the first and second control units are configured to receive information indicative of the target state; and wherein the first and second control units are configured to generate the first and second control signals based on the information indicative of the target state;

wherein the first and second control units are configured to exchange control data indicative of the first and second control signals, respectively.

2. The driver circuit of claim 1, wherein the first control unit generates the first control signal using a first control algorithm with a first set of coefficients;

the second control unit generates the second control signal using a second control algorithm with a second set of coefficients;

the exchanged control data comprises the first and/or second sets of coefficients.

3. The driver circuit of claim 2, wherein the first and/or second control algorithm comprises a PID control algorithm; and/or the first and/or second sets of coefficients comprise a proportional gain, an integral gain and/or a derivative gain.

4. The driver circuit of claim 2, wherein the first and second control units are configured to determine the first and second sets of coefficients such that a trade-off between convergence speed and stability is increased.

5. The driver circuit of claim 1, wherein the second control unit generates the second control signal based on the control data indicative of the first control signal.

6. The driver circuit of claim 1, wherein the state control unit is configured to determine the target state from a current state using a state machine;

the state machine comprises a plurality of states indicative of a plurality of corresponding illumination levels of the light source, and a plurality of transitions between at least some of the plurality of states; and the plurality of transitions is subject to a respective plurality of events.

7. The driver circuit of claim 1, wherein the controller is configured to receive information indicative of a target dim level of the light source; and the first and second control units are configured to generate the first and second control signals based on the information indicative of the target dim level of the light source.

8. The driver circuit of claim 7, wherein the controller is configured to receive information indicative of a type of dimmer used to set the target dim level; and the first and second control units are configured to generate the first and second control signals based on the type of dimmer.

9. The driver circuit of claim 1, wherein the controller further comprises a central clock signal generator configured to generate a clock signal; and the first and second control unit is synchronized using the clock signal.

10. The driver circuit of claim 1, wherein the controller is configured to receive one or more feedback signals;

the one or more feedback signals comprise one or more of: a signal indicative of the input voltage, a signal indicative of the intermediate voltage, a signal indicative of the drive voltage; and the first and second control units are configured to generate the first and second control signals based on the one or more feedback signals.

11. The driver circuit of claim 1, wherein the input voltage is a rectified version of a mains voltage.

12. The driver circuit of claim 1, wherein the first and second power converter stages comprise switched-mode power converters comprising respective switches; and the first and second control signals comprise pulse width modulated control signals for controlling the respective switches.

13. The driver circuit of claim 1, wherein the first power converter stage comprises a single-ended primary-inductor converter; and/or the second power converter stage comprises a flyback converter.

14. The driver circuit of claim 1, wherein the first power converter stage comprises an input connection for receiving the input voltage, an output connection for providing the intermediate voltage, and a switch device, the input connection, the output connection and the switch device sharing a common reference potential; and/or the second power converter stage comprises an input connection for receiving the intermediate voltage, an output connection for providing the drive voltage, and a switch device, the input connection, the output connection and the switch device sharing a common reference potential.

15. A light bulb assembly comprising:

a housing;

a solid state light emitting device, located within the housing;

an electrical connection module, attached to the housing, and adapted for connection to a mains supply; and a driver circuit, located within the housing, connected to receive an electricity supply signal from the electrical connection module, and operable to supply an electrical drive signal to the light emitting device, comprising:

a first power converter stage configured to convert an input voltage into an intermediate voltage;

a second power converter stage configured to convert the intermediate voltage into a drive voltage for the light source; and a controller comprising a first control unit configured to generate a first control signal for the first power converter stage;

a second control unit configured to generate a second control signal for the second power converter stage; and a state control unit configured to determine a target state of the light source;

wherein the first and second control units are configured to receive information indicative of the target state; and wherein the first and second control units are configured to generate the first and second control signals based on the information indicative of the target state;

wherein the first and second control units are configured to exchange control data indicative of the first and second control signals, respectively.

* * * * *